US005554490A

United States Patent [19]

Imaeda

[11] Patent Number: 5,554,490

[45] Date of Patent: Sep. 10, 1996

[54] RELIEF PATTERN PRODUCING METHOD AND APPARATUS AND RELIEF PATTERN SHEET

[75] Inventor: Mikio Imaeda, Bisai, Japan

[73] Assignee: Brother Kogyo Kabushiki Kaisha, Nagoya, Japan

[21] Appl. No.: 432,929

[22] Filed: May 1, 1995

[30] Foreign Application Priority Data

May 13, 1994 [JP] Japan ..... 6-099918

[51] Int. Cl.[6] ..... G03C 5/16

[52] U.S. Cl. ..... 430/327; 430/944; 430/322; 430/330

[58] Field of Search ..... 430/292, 944, 430/152, 322, 330, 327

[56] References Cited

U.S. PATENT DOCUMENTS 4,371,602 2/1983 Iwasaki et al. ..... 430/190 X 5,122,430 6/1992 Nishitsuji et al. ..... 430/110

FOREIGN PATENT DOCUMENTS 61 072589 4/1986 Japan .

*Primary Examiner*—Cynthia Hamilton
*Attorney, Agent, or Firm*—Oliff & Berridge

[57] ABSTRACT

A plurality of circular figures, each having the same diameter, are formed on a thermal expansile layer, made of a material which is foamed upon heating as a result of absorption of light, in such way that they are spaced at intervals more than 0.3 times as large as a diameter of each circular figure. Upon exposure of the figures to light, each circular figure absorbs light to produce heat. At this time, since the circular figures are formed with appropriate constant intervals between them, the circular figures are raised so as to have uniform size and shape without being affected by the light absorption and heat generation of other circular figures.

13 Claims, 13 Drawing Sheets

RELIEF PATTERN PRODUCING METHOD AND APPARATUS AND RELIEF PATTERN SHEET

BACKGROUND OF THE INVENTION

1. Field of the Invention

This invention relates to a relief pattern producing method and a relief pattern sheet produced using such the method.

2. Description of Related Art

Methods for producing a relief pattern sheet have previously been proposed. According to a method disclosed, for example, in U.S. Pat. No. 4,268,615, a layer of a desired pattern is formed on the surface of a thermal expansile sheet, wherein the pattern layer is made of a material being more optically absorptive than the thermal expansile sheet, and wherein when the surface of the thermal expansile sheet is exposed to light, the patterned portion of the sheet is selectively heated to rise by virtue of a difference in optical absorption.

Moreover, Japanese Laid-Open Publication No. 61-72589 discloses a pattern forming method, wherein a highly optically absorptive pattern is formed by thermal transfer, and this pattern is exposed to light to produce a relief pattern corresponding to an image signal on an expandable foaming substance.

These methods permit a relief pattern to be formed on a sheet with a simple operation.

However, when a plurality of figures are formed on a thermal expansile sheet utilizing these methods and the sheet is then exposed to light, thermal interaction arises between the figures, which makes it impossible to create a uniform relief pattern.

Specifically, where an individual figure produces heat, resultant heat dissipates to surrounding low temperature areas because of the lack of another heat generating figure around that figure.

On the other hand, where a plurality of adjoining figures simultaneously produce heat, an ambient temperature around the figures rises, which in turn delays dissipation of heat resulting from optical absorption. For this reason, a thermal expansile layer must be heated for a long time, and therefore, the degree of expansion of the figures becomes larger when compared with the case of the independent figure.

In addition, where figures adjoin only in one direction, the speed of dissipation of developing heat is delayed only in this direction, and hence, a part of the figure being adjacent another figure is heated much more. Accordingly, only this adjoining portion expands significantly, resulting in distorted expanded figures.

The above mentioned phenomena will be explained with reference to following examples.

FIGS. 2A and 2B are top and cross-sectional views respectively of a relief pattern sheet after a circle 15, having a diameter R1 and being formed on a non-illustrated thermal expansile sheet by thermal transfer, has thermally expanded upon exposure to light. D1 designates the height of a raised part.

FIGS. 3A and 3B are top and cross-sectional views respectively of a relief pattern sheet after four circles 16, 17, 18, and 19, each having the same diameter R1 as that of the circle 15 shown in FIG. 2A and being formed at intervals of L2 by thermal transfer, have thermally expanded upon exposure to light. In these drawings, the relationship between the diameter R1 of the circle and the interval L2 between the circles will be written as L2=0.2×R1.

Upon exposure of the thermal expansile sheet on which a plurality of circles, each circle having the same area, are formed at small intervals to light, each circular region absorbs an equal amount of light to produce heat. Heat developing from four circular regions is substantially the same, and the heat simultaneously dissipates to surrounding areas of the circular regions in the thermal expansile sheet.

First, consider the dissipation of heat from the circle 17. The circle 17 is sandwiched between the circles 16 and 18. Heat flows from two circles into regions sandwiched between the circles 17 and 16 and between the circles 17 and 18, whereby the temperatures of these regions increase. Generally, the speed of dissipation of heat is proportional to a temperature gradient in the direction of dissipation, and therefore, dissipation of heat from the circle 17 is delayed when a temperature in the direction of dissipation of heat has risen more rapidly in this case. This causes the sandwiched regions to be heated for a longer time, and the regions expand much more when compared with the independent circle shown in FIGS. 2A and 2B. For this reason, as shown in the cross-sectional view of FIGS. 3A and 3B, the height D2 of the raised portions is larger than D1 of FIG. 2B. The circle 18 is also sandwiched between the two circles 17 and 19, and therefore, the circle 18 expands in the same manner as the circle 17.

Since the circle 17 is formed on the right of the circle 16, heat flows from two circles into the region sandwiched between the circles 16 and 17 in the same manner as previously mentioned, so that the temperature of that region resultantly increases. Therefore, the speed of dissipation of heat from the circle 16 to the right becomes equivalent to that of the circle 17. On the other hand, no circle is adjacent the left of the circle 16, and hence, heat is given off from the circle 16 to the left in the same manner as the dissipation of heat from the circle shown in FIGS. 2A and 2B.

Consequently, heat is radiated from the circle 16 slowly toward the right but rapidly toward the left. This results in figures disproportionately expanding in a lateral direction. The height of a right half of the raised portion of the circle 16 becomes substantially equal to that of the circles 17 and 18, but the height of a left half of the raised portion of the circle 16 becomes substantially equal to that of the independent circle shown in FIGS. 2A and 2B. The circle 19 is a mirror image of the circle 16, and therefore, the height of a right half thereof is lower, but the height of a left half of the same is higher.

In this way, when a plurality of relief patterns are formed on one sheet, if figures are too closely spaced from each other, dissipation of heat from the figures, whose temperatures are increased after being exposed to light, will interact with dissipation of heat from surrounding other figures, resulting in raised figures having non-uniform shapes and sizes.

SUMMARY OF THE INVENTION

An object of this invention is to provide a relief pattern producing method that makes it possible to raise desired figures on a thermal expansile sheet while maintaining uniform shapes and sizes.

To this end, according to one aspect of this invention, there is provided a thermal expansile sheet for use with a method for forming a relief pattern including the steps of forming figures on a thermal expansile sheet having a foaming layer laid on a base material, the foaming agent being made of a material that is foamed upon heating, by a highly optically absorptive material; and exposing the thermal expansile sheet to light including infrared rays to cause the foaming layer covered with the figures formed on the thermal expansile sheet to be heated and foamed so that relief patterns corresponding to the figures are formed on the thermal expansile sheet. More than two figures are formed on the thermal expansile sheet in such a way that a separation interval between two arbitrary points in the figures is set to more than 0.3 times, more preferably, more than 0.5 times as large as a diameter of a circle whose area is equal to an area of a larger one of the two figures.

In a relief pattern sheet according to the present invention, when the thermal expansile sheet is exposed to light including infrared rays, a part of the foaming layer covered with the figures formed on the thermal expansile sheet is foamed upon heating, so that relief patterns corresponding to the figures are formed on the thermal expansile sheet.

According to the thermal expansile sheet having the above-mentioned construction, more than two optically absorptive figures are formed on the foaming layer of the thermal expansile sheet. Upon exposure of this expandable recording substance, i.e., the foaming layer, to light including infrared rays, only the areas of the expandable recording substance covered with the figures absorb light to produce heat. At this time, the figures are spaced at intervals that are larger than minimal required intervals, and therefore, generation of heat does not affect heat generation in other figures. For this reason, it becomes possible to expand a plurality of figures to assume the same shape as an independent figure expands upon exposure to light.

Moreover, according to the relief pattern sheet, a relief pattern is formed to have the same shape as an independent figure expands upon exposure to light.

As is evident from the above explanation, according to the thermal expansile sheet and the relief pattern sheet of the invention, an interval between two arbitrary figures of the plurality of figures is set to more than 0.3 times as large as a diameter of a circle whose area is equal to an area of a smaller one of the two, when a plurality of optically absorptive figures are formed on the thermal expansile sheet. For this reason, when the entire surface of the thermal expansile layer, over which optically absorptive figures are drawn, is exposed to light including infrared rays to selectively expand the surface, a desired relief pattern can be formed without experiencing figure distortion heat generation resulting from absorption of light by other figures.

A relief pattern producing apparatus is also provided.

BRIEF DESCRIPTION OF THE DRAWINGS

A preferred embodiment of the present invention will be described in detail with reference to the following figures wherein.

DETAILED DESCRIPTION OF PREFERRED EMBODIMENTS

One illustrative example of a thermal expansile sheet and a relief pattern sheet embodying the present invention will be described hereunder with reference to the drawings.

Figure 6:
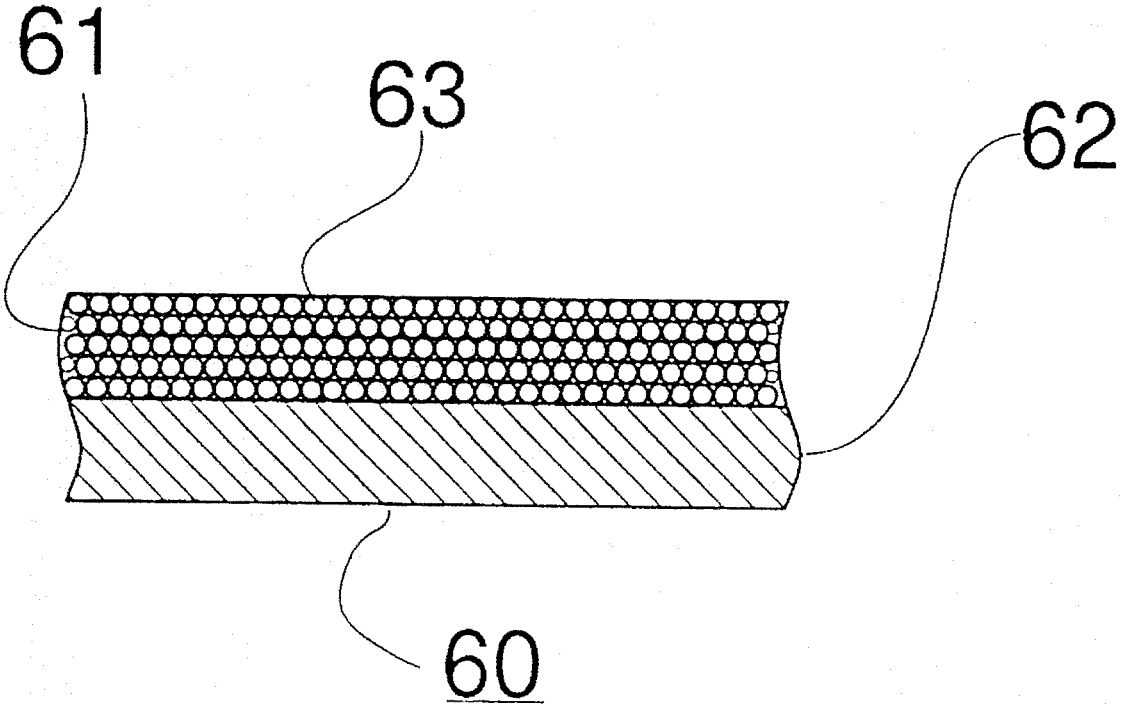
FIG. 6 is a cross-sectional view of a thermal expansile sheet for use with the thermal expansile sheet according to the present invention.

FIG. 6 is a cross-sectional view of a thermal expansile sheet, which constitutes a thermal expansile sheet according to the present invention, in which a thermal expansile sheet 60 is made of a thermal expansile layer 61 laid on a base material 62.

The thermal expansile layer 61 is made by dispersing a foaming agent 63 in a thermoplastic resin.

Substances that evolve nontoxic gas as a result of thermal decomposition are appropriately used as the foaming agent 63; for example, bicarbonate such as sodium bicarbonate, various types of peroxide, diazoaminobenzene, aluminum para-dicarboxylate, and azo compounds such as azobisisobutyronitrile.

A thermal expansile microcapsule having a diameter of 10–20 μm may be used as the foaming agent 63, in which volatile substances having a low boiling point, such as propane and butane, are encapsulated within a shell material consisting of polystyrene, polyvinyl chloride, polyvinylidene chloride, polyvinyl acetate, polyacrylic ester, polyacrylonitrile, polybutadiene, or copolymers thereof.

Such a foaming agent 63 is dispersed into a solution or emulsion of resin which will be used as a binder, using a known dispersion mixer such as a roll mill or a sand mill. The resulting solution or emulsion is applied over the base material 62 using a known coating apparatus. The base material 62 is then dried so that the thermal expansile layer 61 is formed.

Thermoplastic resins such as vinyl-acetate-based polymers and acrylic polymers are preferably used as the resin for use as a binder so that the resin can be thermally softened to form a stable foaming layer at the same time that the foaming agent 63 is thermally decomposed upon heating and gas is evolved or so that the thermal expansile capsule thermally expands.

In addition to smoothness, water-resistance, and tensile strength, rigidity, which prevents the thermal expansile layer 61 from inflating toward the base material side when the foaming agent 63 is foamed, is also a required property of the base material 62. For example, besides paper, synthetic paper such as polypropylene, and various types of plastic film such as polyethylene terephthalate (PET) and polybutylene terephthalate (PBT) are preferably used as the base material having the property set forth above. Among these base materials, when a PET film, subjected to a foaming treatment and incorporating a lot of bubbles therein, is used, it is possible to raise an image with smaller energy because of its high heat insulating effect.

Figure 7:
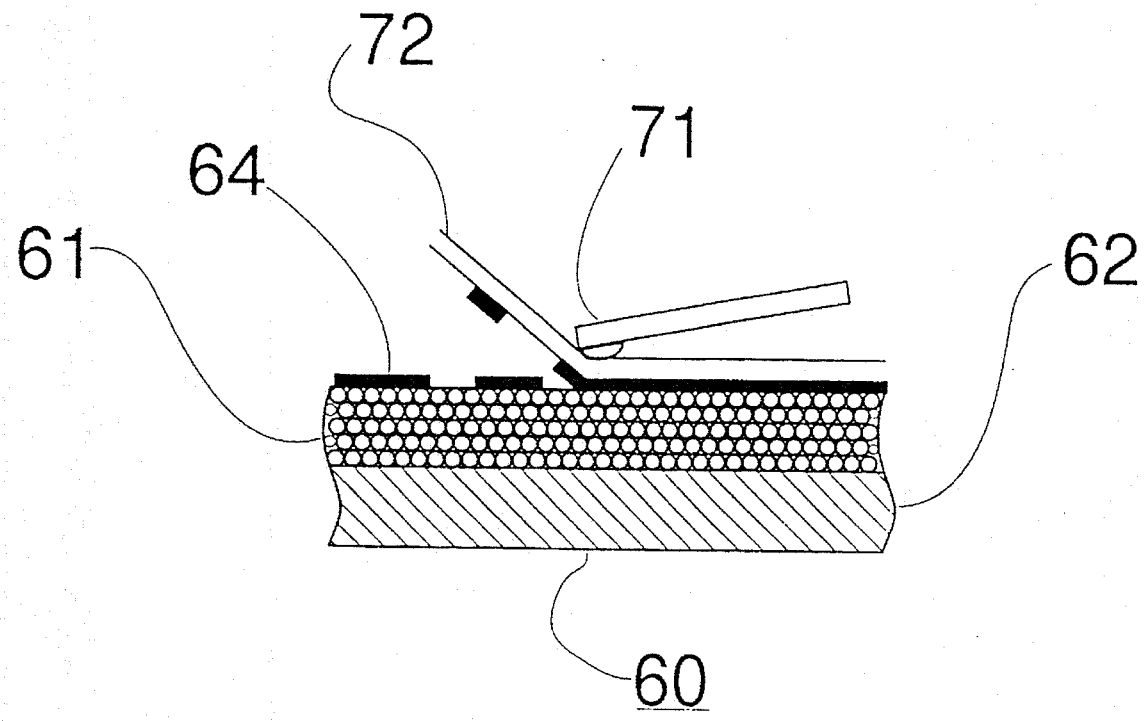
FIG. 7 is an explanatory view showing a process for thermally transferring an optically absorptive image to the thermal expansile sheet.
Figure 8:
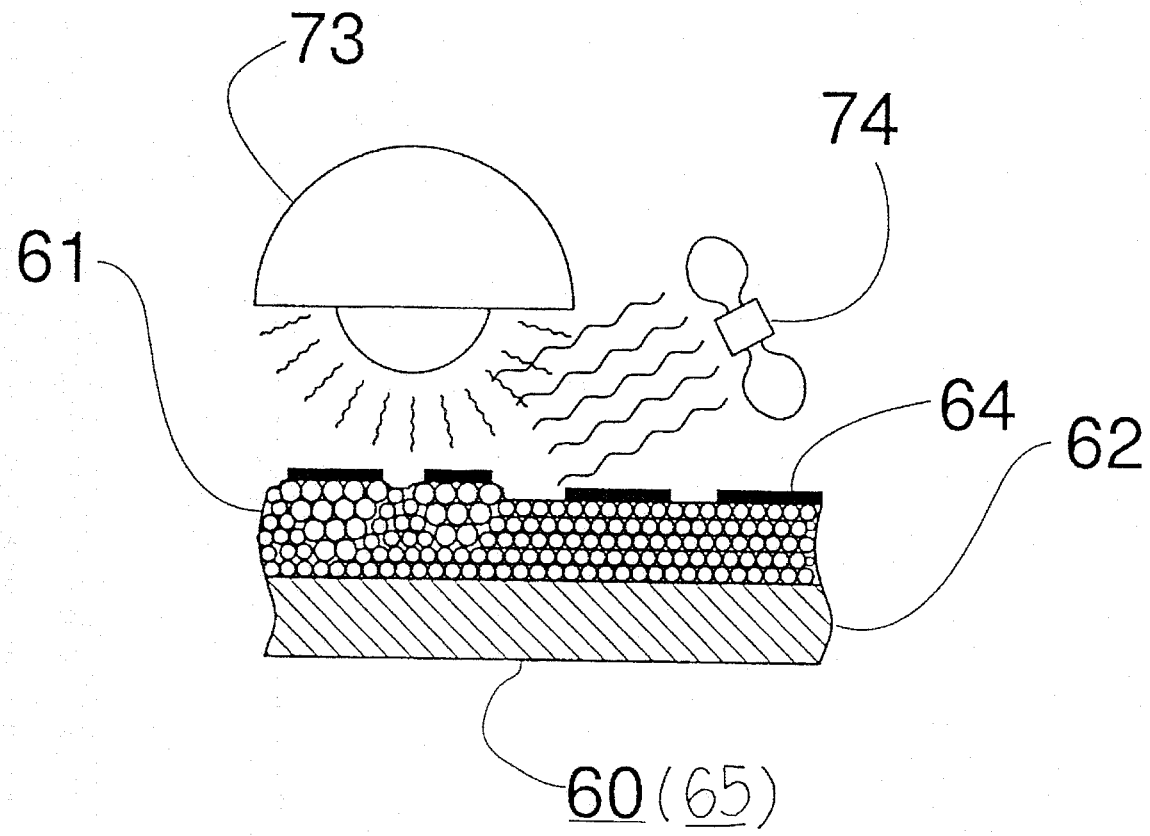
FIG. 8 is an explanatory view showing a process for producing a relief pattern sheet by causing figures on the thermal expansile sheet to rise.

Referring to FIGS. 7 and 8, a method for preparing a relief pattern sheet will be described.

As shown in FIG. 7, for example, a thermal transfer ribbon 72 to be used in a thermal transfer recorder is first superimposed on the thermal expansile layer 61. A thermal head 71 provided as a recording means in the thermal transfer recorder is pressed against the rear surface of the thermal transfer ribbon 72. The thermal head 71 is heated under the control of a control unit described below on the basis of an image signal, and hence, a part of an ink layer on the thermal transfer ribbon 72 corresponding to the thermal head is melted, whereby the melted ink is fused to the surface of the thermal expansile layer 61. When the thermal transfer ribbon 72 is exfoliated after the ink has been cooled, only an image formed in an ink layer of the thermal transfer ribbon 72 is transferred to the thermal expansile layer 61, whereby an image 64 is formed as a figure on the thermal expansile layer 61.

Figure 9:
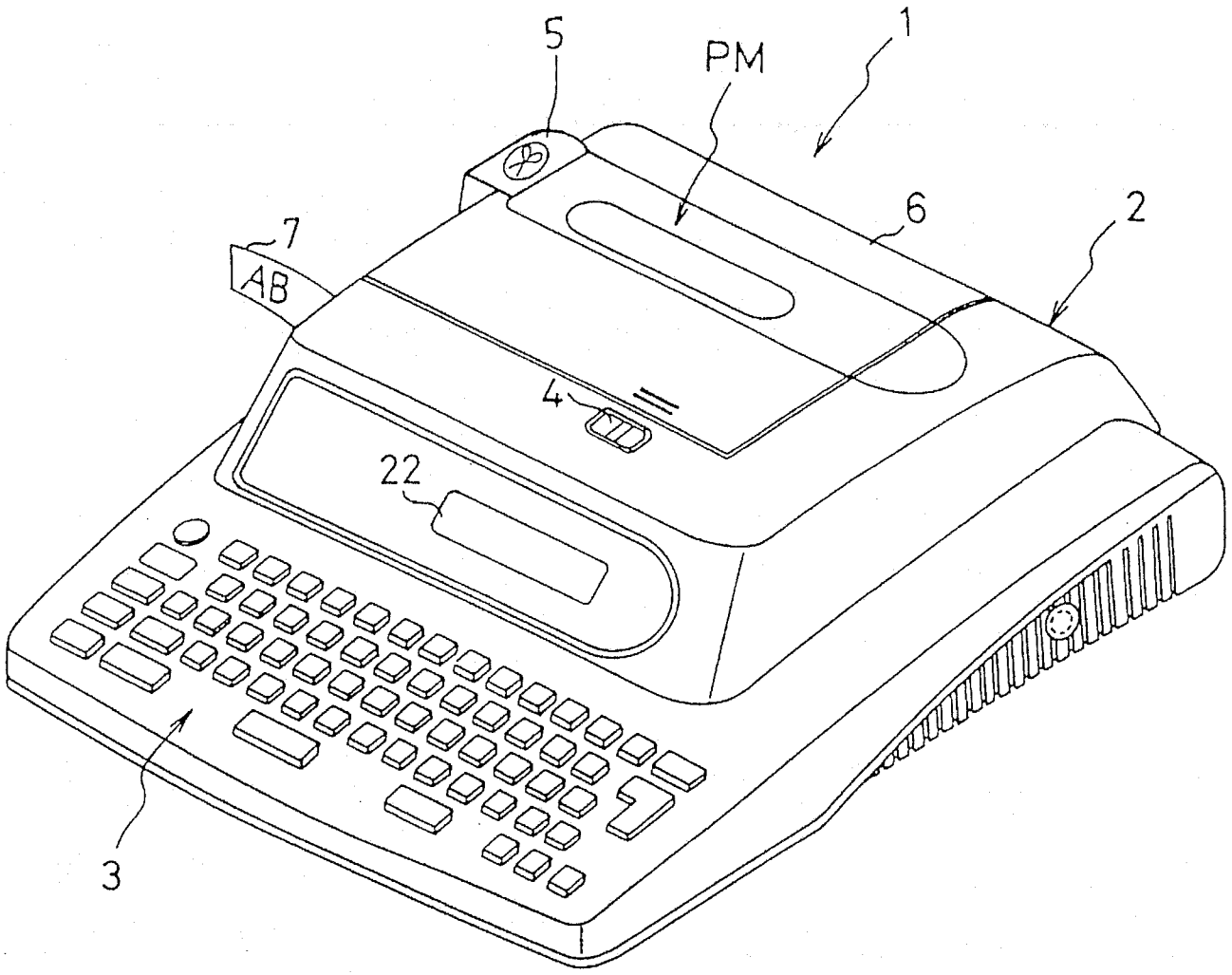
FIG. 9 is a perspective view showing one example of a tape printer that utilizes a thermal expansile tape.
Figure 10:
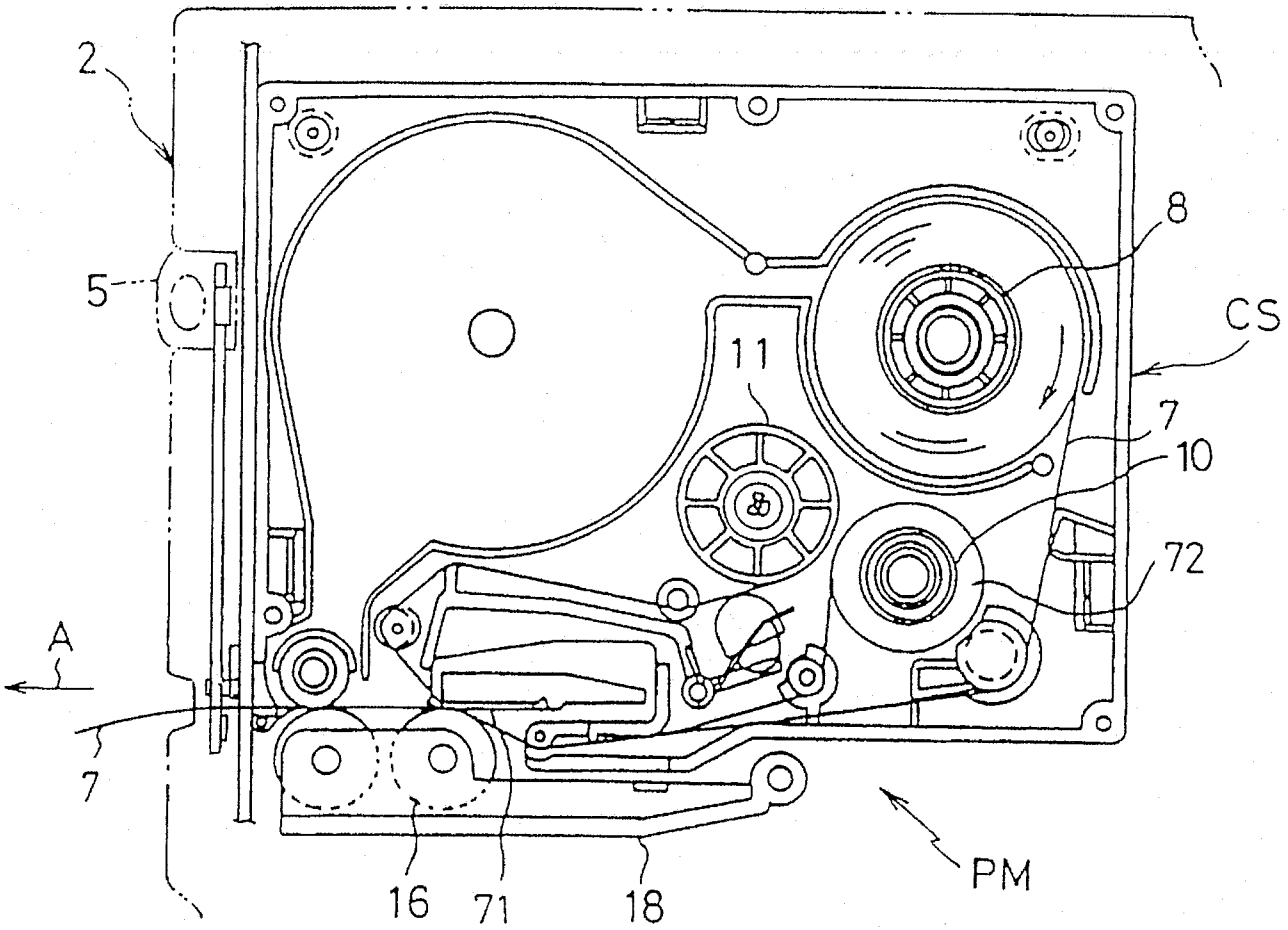
FIG. 10 is an explanatory view of a thermal expansile tape cassette to be inserted into the tape printer shown in FIG. 9.

The thermal expansile sheet 60 and the thermal transfer ribbon 72 of the previous embodiment may be housed in a cassette, which will be described later, and the thermal expansile sheet and the thermal transfer ribbon housed in the cassette may be used in a tape printer, which will be also described later. Referring to FIGS. 9 and 10, a cassette and a tape printer in which the thermal expansile sheet 60 in the previous embodiment is used will now be described.

As shown in FIG. 9, a keyboard 3 is arranged at a front part of a main body frame 2 of a tape printer 1, and a printing mechanism PM is arranged within the main body frame 2 behind the keyboard 3. A liquid crystal display 22, which can display characters and codes for one line, is provided immediately behind the keyboard 3. A release button 4 for releasing a cover frame 6 when a tape cassette CS to be loaded into the printing mechanism PM is inserted and removed, and a separation operation button 5 for manually separating a printed tape are provided on the main body frame 2.

The keyboard 3 is provided with character keys for inputting alphanumeric characters, numerals, and codes; a space key; a return key; a cursor shift key for vertically and horizontally moving a cursor key; a size setting key for setting the size of characters to be printed; an execution key for instructing the execution of various processing; a cancel key for canceling preset contents; a print key for instructing printing; and a power key for turning a power supply on and off.

Figure 11:
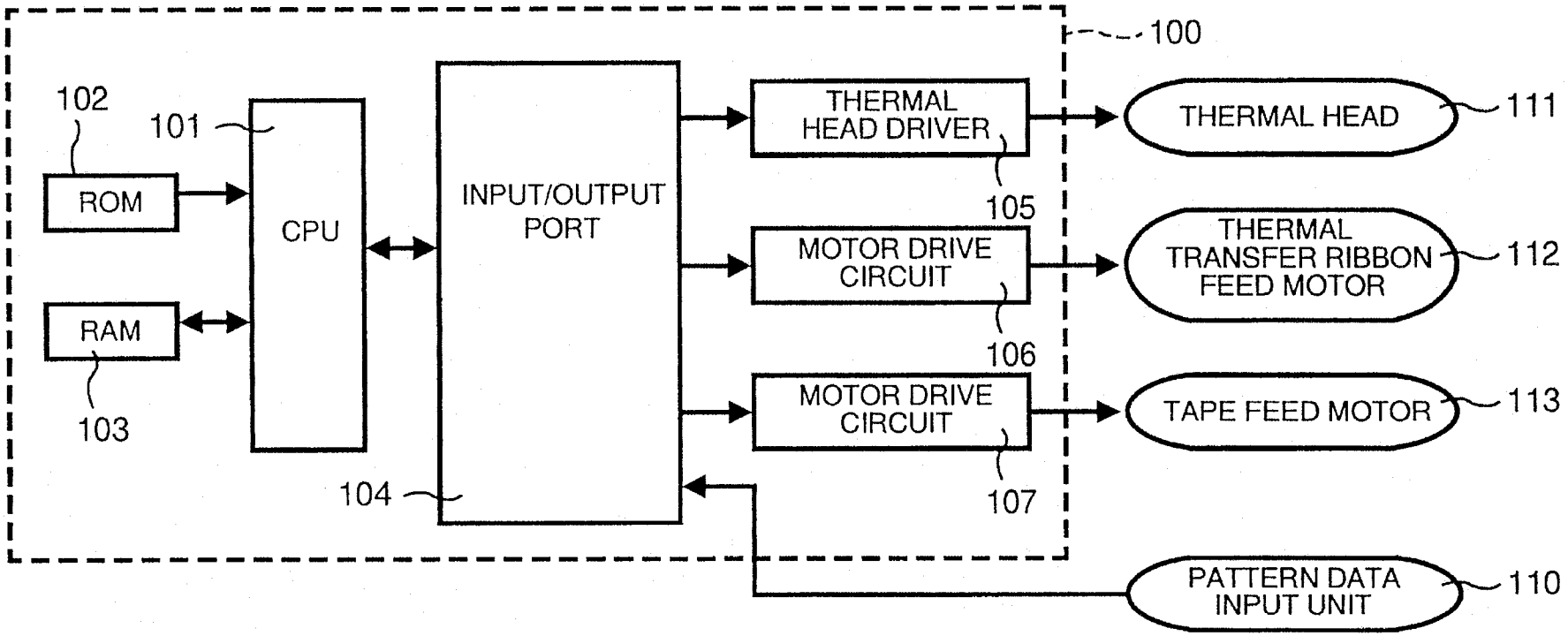
FIG. 11 is a block diagram illustrating the tape printer shown in FIG. 9.

Referring to FIG. 11, a control unit 100 of the tape printer I according to the present invention will be described. The tape printer 1 includes a control unit 100 that controls the operation of a thermal head 111, a thermal transfer ribbon feed motor 112 and a tape feed motor 113. A pattern data input unit (keyboard) 110 communicates with the control unit 100 through an input/output port 104.

The control unit 100 includes a ROM 102 storing programs for controlling the tape printer 1 as well as a dictionary memory for KANA-KANJI conversion and a pattern memory for storing dot pattern data for printing, a RAM 103 storing image pattern data of characters and symbols input from pattern data input unit 110 and storing print data that is developed based on the image pattern data, and a CPU 101 communicating with RAM 103 and ROM 102 and controlling the operation of the apparatus.

The control unit 100 further includes a thermal head driver 105 that controls the thermal head 111 based on a signal from CPU 101 and motor drive circuits 106, 107 that control the thermal transfer ribbon feed motor 112 and the tape feed motor 113, respectively, based on a signal from CPU 101. CPU 101 communicates with drivers 105–107 via the input/output port 104.

Referring to FIG. 10, the printing mechanism PM will be briefly explained. The tape cassette CS is removably loaded into the printing mechanism PM. This tape cassette CS is provided with a tape spool 8 around which a thermal expansile tape 7, consisting of the tape-like thermal expansile sheet 60, is coiled with the thermal expansile layer 61 thereof facing inside, a ribbon supply spool 10 around which the thermal transfer ribbon 72 is coiled, and a take-up spool 11 that takes up the thermal transfer ribbon 72.

A thermal head 71 is provided in an upright manner at a position where the thermal expansile tape 7 and the thermal transfer ribbon 72 overlap, and platen rollers 16, which press the thermal expansile tape 7 and the thermal transfer ribbon 72 against a thermal head 71, are rotatably attached to a support 18, which is in turn rotatably attached to the main body frame 2. A heat generation element group consisting of 128 individual heat generation elements is vertically provided in a line.

Desired characters and braille letters are printed on the thermal expansile layer 61 of the thermal expansile tape 7 by means of the thermal head 71 via the thermal transfer ribbon 72. The thermal expansile tape 7 is then fed in the direction of the arrow A and is transported to the outside of the main body frame 2.

The thus obtained thermal expansile tape 7 is cut by the operation of the separation operation button 5. As with the previous embodiment, the separated thermal expansile tape 7 is exposed to light using a lamp 73, so that a relief pattern is formed on the thermal expansile tape 7 as explained in detail below with reference to FIG. 8.

In this embodiment, although the thermal head 71 of the thermal transfer recorder is used for forming an image on the thermal expansile layer 61, members other than the thermal head 71 may be employed. By way of example, it is possible to cause a laser beam, whose intensity is modified on the basis of an image signal, to scan across the rear surface of the thermal transfer ribbon 72 so that the ribbon is heated. As a result of this, a part of the ink layer of the thermal transfer ribbon 72 exposed to the laser beam having a strong intensity is melted, and the melted ink is fused to the surface of the thermal expansile layer 61.

A material that generates heat upon absorption of light is used as ink for use with the thermal transfer ribbon 72. For example, when a black print image is desired, carbon black should be used. The carbon black possesses properties of absorbing light from visible light to near infrared rays and converting such light energy to heat.

On the other hand, when colored print images other than black are necessary, known dye or pigment, for example, in red, blue, yellow, or the like, is used with the ink. However, since the dye or pigment is less optically absorptive in the range of infrared rays, it is impossible to sufficiently convert light energy to heat. For this reason, it is necessary to cause the dye or pigment to be more optically absorptive in the range of infrared rays by appropriately mixing composite oxides, which contain tin, antimony, or indium as principal components, into the composition of ink.

An optically absorptive image is formed on the thermal expansile layer 61 of the thermal expansile sheet through the above-mentioned steps.

As shown in FIG. 8, the thermal expansile sheet 60, which is similar to the thermal expansile tape 7 formed by the tape printer described above, carrying the optically absorptive image, is exposed to light by the use of the lamp 73. Any lamp that can emit light ranging from visible light to near infrared rays, such as a tungsten lamp, a halogen lamp or a xenon lamp, may be used as the lamp 73. When exposed to light using the lamp 73, the thermal expansile sheet 60, carrying optically absorptive images, is exposed to light while either the thermal expansile sheet 60 or the lamp 73 is being shifted in one direction. This makes it possible to uniformly expose a wide surface of the thermal expansile sheet to light. Although an appropriate time for irradiation depends on the intensity of light to be irradiated, it is preferable to irradiate light for at least one minute and within about four minutes.

Upon exposure of the optically absorptive image 64 formed on the thermal expansile layer 61 to light from the lamp 73, the image 64 absorbs and converts the light to heat energy. For this reason, the thermal expansile layer 61 covered with the image 64 is heated. When the foaming agent 63 is used, the foaming agent 63 is foamed upon heating and decomposition, whereby the surface of the thermal expansile layer 61 is raised. Alternatively, when a thermal expansile capsule is used, the surface of the thermal expansile layer 61 is raised as a result of expansion of the capsule. Thereby, a relief pattern sheet is produced in which a relief pattern corresponding to the image 64 is formed.

At this time, air is blown toward the surface of the thermal expansile layer 61 by means of a fan 74 at the same time as the exposure of the thermal expansile layer to light from the lamp 73, whereby the ambient temperature around the thermal expansile layer 61 is prevented from increasing. This makes it possible to increase a difference in temperature between the area that absorbs light to bring about a temperature rise and the area that reflects light to prevent a temperature rise. For this reason, only a desired area of the thermal expansile layer 61 can be raised, and the resolution of a pattern in relief can be improved.

Figures 1A, 1B:
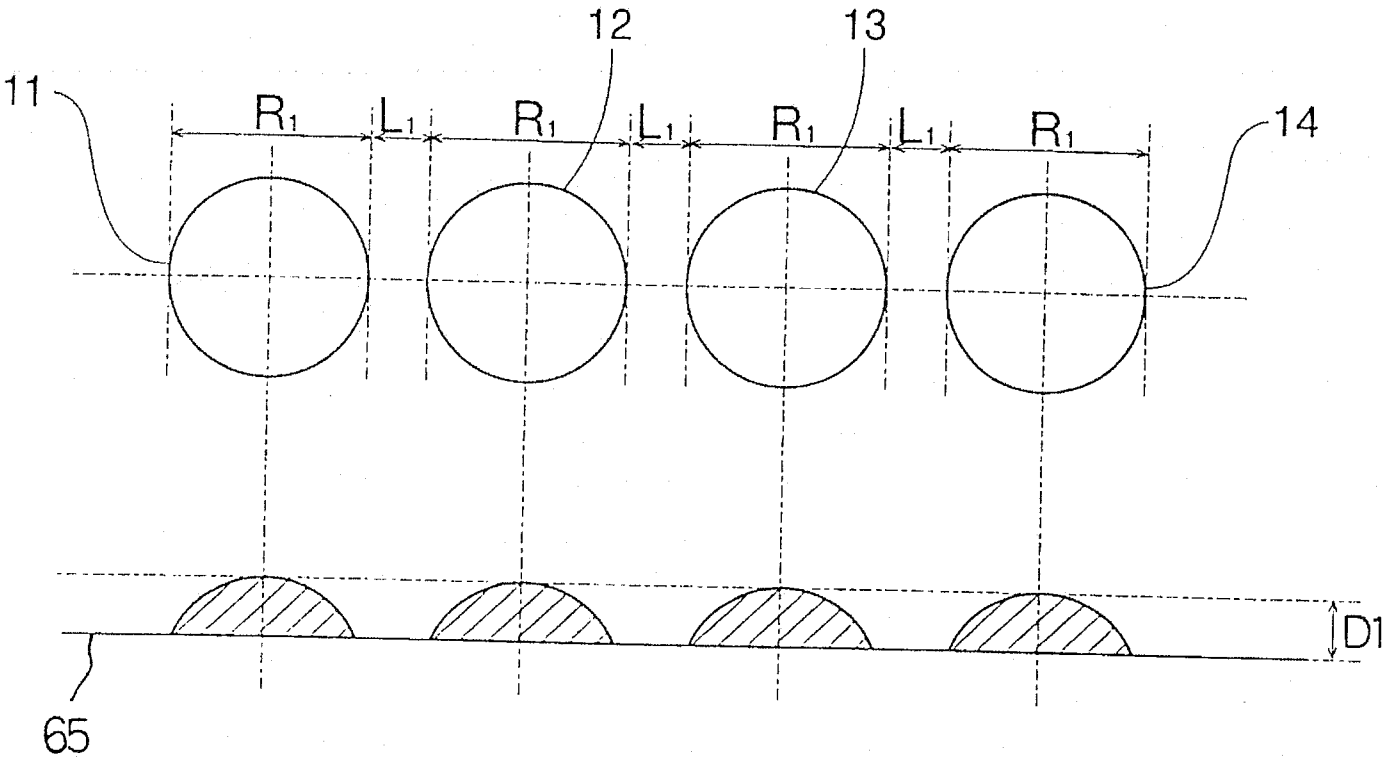
FIGS. 1A and 1B are top and cross-sectional views respectively of a relief pattern sheet according to the present invention.

FIGS. 1A and 1B are top and cross-sectional views respectively of a relief pattern sheet after four circles 11, 12, 13 and 14 have thermally expanded upon exposure to light. Each circle has the same diameter R1 as that of the circle 15 shown in FIG. 2A and is formed at intervals of L1 by the use of the relief pattern producing method as described in detail above. In the drawings, the relationship between the diameter R1 of the circular figure, serving as a pattern, and the separation interval L1 of each circular figure will be written as follows:

$$L1=0.3\times R1$$

Even in this embodiment, when the entire thermal expansile sheet 60, containing these circular figures, is exposed to light, each circular figure absorbs the same quantity of light to produce heat. Heat developing from the four circular figures is substantially the same, and the heat simultaneously dissipates to the surrounding area of the circular figures.

Figures 3A, 3B:
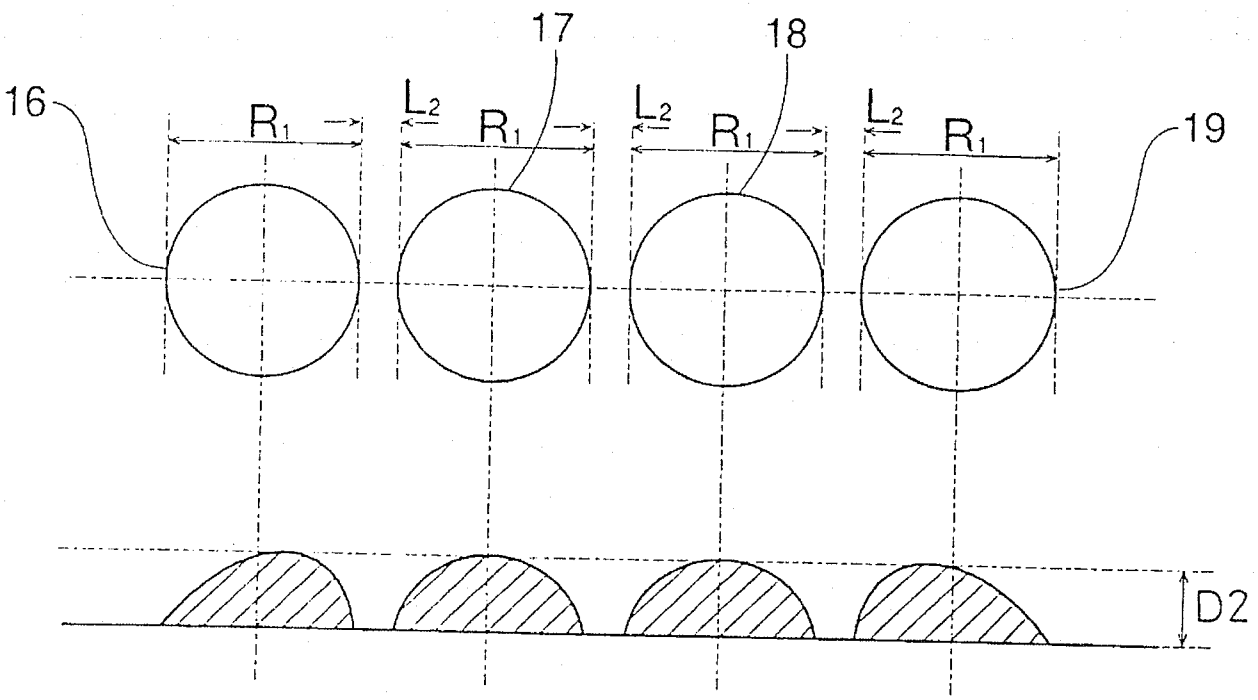
Fig.3 A RELATED ART
Fig.3 B RELATED ART
FIGS. 3A and 3B are top and cross-sectional views respectively of a conventional relief pattern sheet on which a group of raised circular figures are provided at intervals 0.2 times a diameter of the circular figure.
Figure 12:
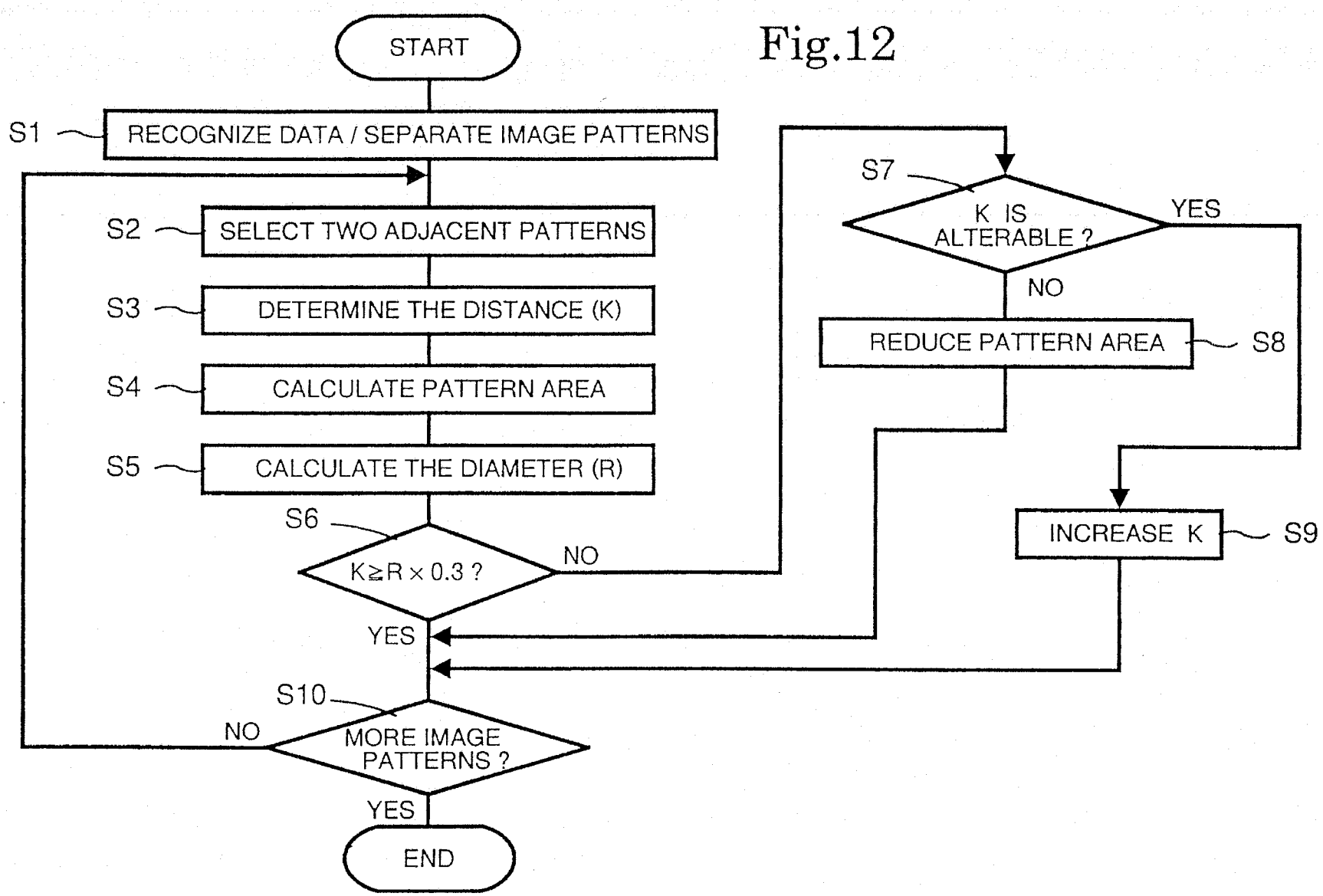
FIG. 12 is a flow chart of the operation performed by the tape printer of FIG. 9.
Figure 13:
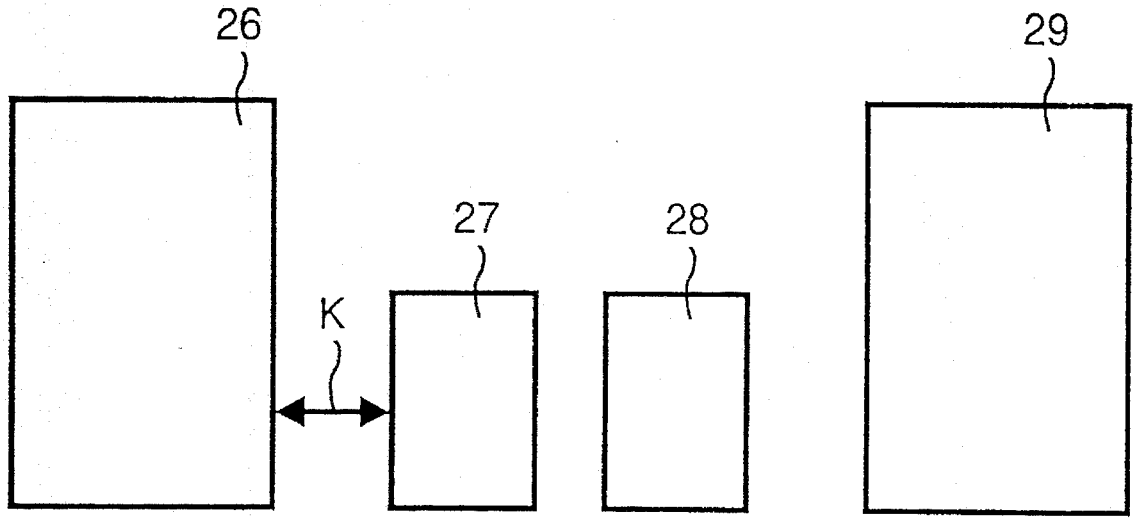
FIG. 13 shows a plurality of image patterns to assist in explaining the flow chart of FIG. 12.

Consideration will be first given of dissipation of heat from the circular FIG. 12. The circular FIG. 12 is sandwiched between the circular FIGS. 11 and 13. Accordingly, heat flows from two circular figures into regions sandwiched between the circular FIGS. 11 and 12 and between the circular FIGS. 12 and 13. However, when compared with the case shown in FIGS. 3A and 3B, the circular FIGS. 11 and 12, and the circular FIGS. 12 and 13 are sufficiently spaced apart from each other (by a distance L=0.3×R1), thereby resulting in an increased heat capacity of the regions between the circular figures. This suppresses a temperature increase.

Figures 2A, 2B:
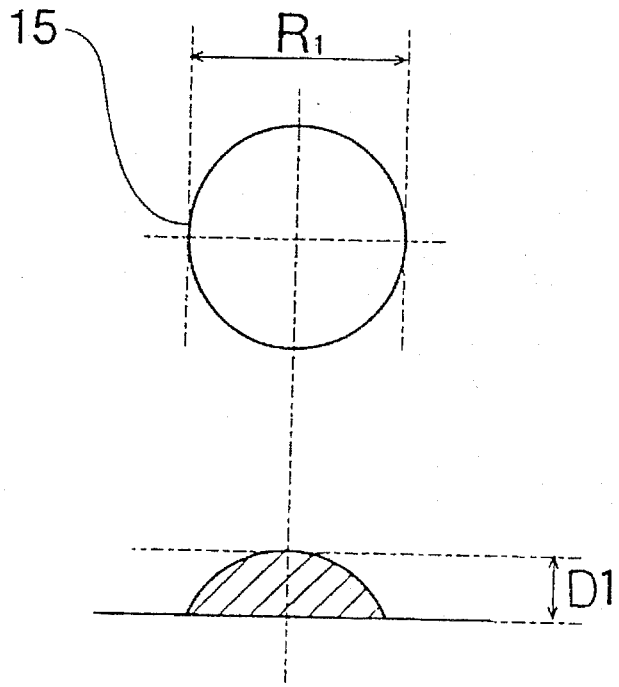
FIGS. 2A and 2B are top and cross-sectional views respectively of a relief pattern sheet on which an isolated raised circular figure is provided.

For this reason, the speed of dissipation of heat from the circular FIG. 12 becomes equal to that of the isolated circular FIG. 15 shown in FIG. 2A. In this way, the size and shape of the circular FIG. 12 shown in FIG. 1 are substantially the same as those of the circular FIG. 15 shown in FIG. 2A, and also the height of the circular FIG. 12 becomes essentially the same as that of the height D1 of the circular FIG. 15 shown in FIG. 2A.

In the case of dissipation of heat from the circular FIG. 13, it is sandwiched between the two circular FIGS. 12 and 14 and expands in the same manner as the circular FIG. 12.

Dissipation of heat from the circular FIG. 11 will now be considered. The circular FIG. 12 is positioned on the right of the circular FIG. 11, and, in the same manner as previously mentioned, heat flows from two circular figures into a region sandwiched between the circular FIGS. 11 and 12. As already mentioned, the circular FIGS. 11 and 12 are spaced apart from each other, resulting in a small amount of temperature increase. Moreover, no figure is adjacent the left of the circular FIG. 11, and hence, heat easily dissipates to the left. Thus, heat dissipates from the circular FIG. 11 at the same speed as heat dissipates from the isolated circular FIG. 15 shown in FIG. 2A.

Consequently, the circular FIG. 11 expands to the same size and shape as the circular FIG. 15 shown in FIG. 2A.

The circular FIG. 14 is also arranged in the same manner as the circular FIG. 11. The circular FIG. 13 is situated on the left of the circular FIG. 14, and no other figure is adjacent the right thereof. Accordingly, the circular FIG. 14 expands in the same manner as the circular FIG. 11.

In this way, in this embodiment, the size and shape of all the four circular figures; i.e., the circular FIGS. 11, 12, 13, and 14 become the same as those of the circular FIG. 15 shown in FIG. 2A. In the case of this embodiment, the relationship between the diameter R1 of the circular figures and the interval L1 between the circular figures will be defined as follows:

$$L1=0.3\times R1$$

On the other hand, in the case of the example of circular figures used in the description of prior art, the corresponding relationship will be written as follows:

$$L2=0.2\times R1$$

As a result of a detailed study conducted into the relationship between the diameter of the circular figure and the interval between the circular figures, if the interval between the circular figures is more than 0.3 times as large as the diameter of the circular figure; namely, $L\geqq 0.3\times R$, it would be possible to obtain a relief pattern sheet on which a relief pattern, having the same size and shape as the independent circular figure, is formed.

Figures 4A, 4B:
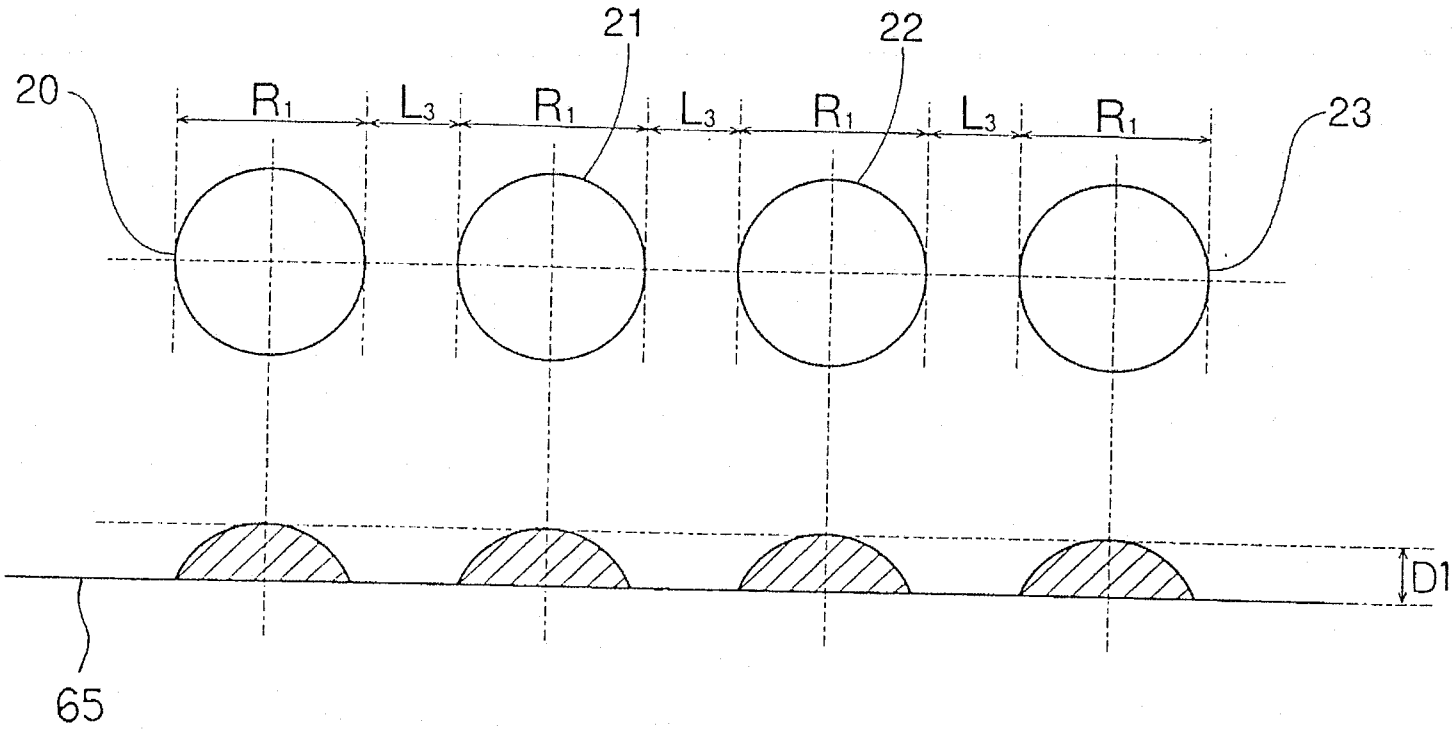
FIGS. 4A and 4B are top and cross-sectional views respectively of a relief pattern sheet according to the present invention.

FIGS. 4A and 4B are top and cross-sectional views respectively of a relief pattern sheet after four circles 20, 21, 22 and 23 have thermally expanded upon exposure to light. Each circle has the same diameter R1 as that of the circle 15 shown in FIG. 2A and is formed at intervals of L3 by known thermal transfer. In FIGS. 4A and 4B, the relationship between the diameter R1 of the circular figures and the interval L3 between the circular figures will be defined as follows:

$$L3=0.5\times R1$$

In the case of this embodiment, when compared with the circular figures shown in FIGS. 1A and 1B that have the intervals defined as L1=0.3×R1, each circular figure is less likely to be affected by other circular figures. Even if the quantity of light is varied, the size and shape of the circular figures would be constant after being expanded.

Figure 5A:
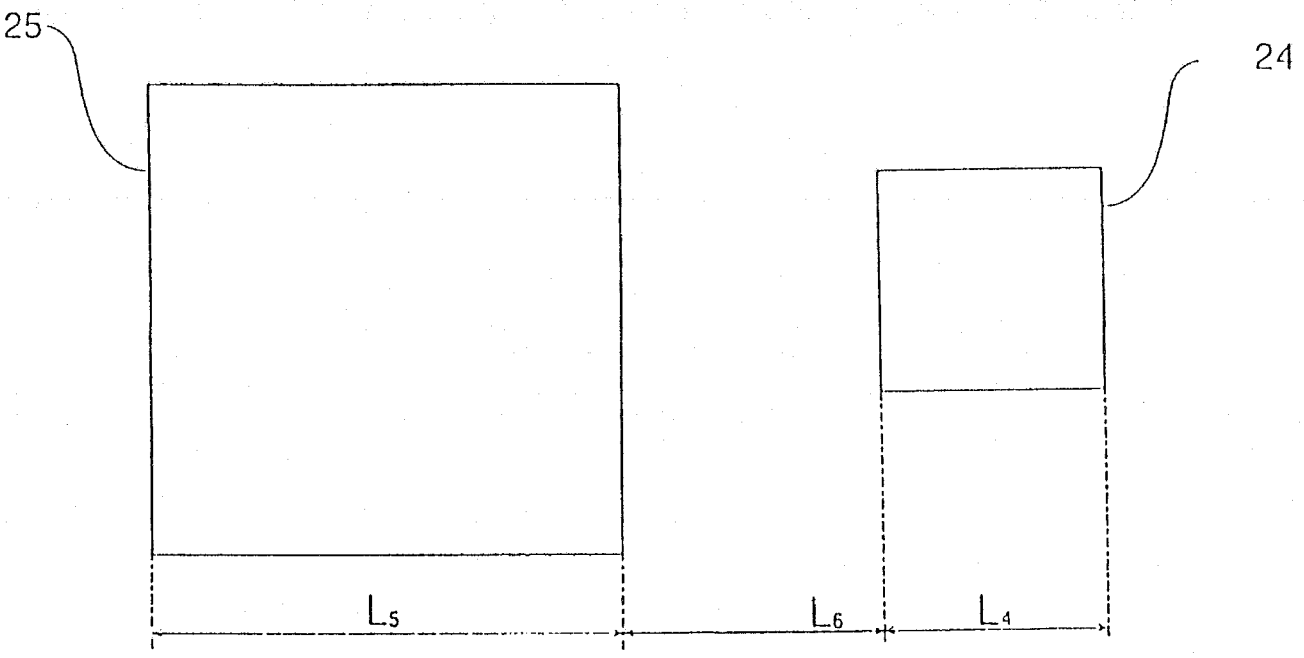
FIGS. 5A and 5B are top and cross-sectional views respectively of another relief pattern sheet according to the present invention.
Figure 5B:
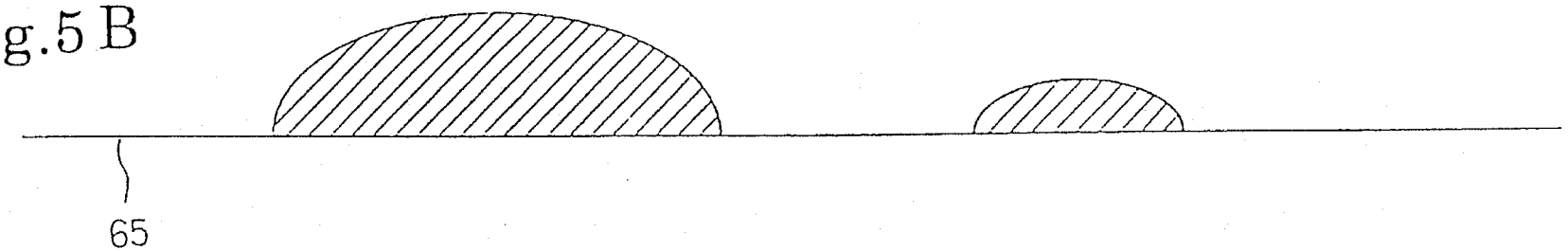

FIGS. 5A and 5B are top and cross-sectional views respectively of a relief pattern sheet after square patterns, having sides of length L4 and L5 respectively and being formed at intervals of L6 by thermal transfer, have thermally expanded upon exposure to light.

The following expression represents a radius of a non-illustrated circular figure having the same area as that of the square pattern 25 having a larger area of the two square patterns shown in FIGS. 4A and 4B.

$$RC=\sqrt{(L5)^2/\pi}$$

The radius RC of the circular figure is represented by the square root of $L5^2$.

In this example, the interval L6 between the square patterns 24 and 25 will be defined as follows:

$$L6=0.5\times(2\times RC)$$

Specifically, the interval is 0.5 times as large as the diameter of the non-illustrated circular figure whose area is equal to that of the square pattern 25. Therefore, these figures will rise without being affected by heat from adjoining figures even if the adjoining figures respectively produce heat upon exposure to light.

Although the figures in this example are squarely formed for simplicity, the same result will be obtained if the figures are formed into arbitrary polygonal shapes. In addition, if a plurality of figures assuming different shapes was mixedly formed, it would be possible to raise the figures in an optimum manner by obtaining optimum intervals between the figures from their areas in the same way as previously mentioned.

Further, when adjoining figures differ in size from each other, the interval L between the figures is set to more than 0.3 times as large as that of a diameter of a circle whose area is the same as that of a larger one. As a result of this, if the figures respectively produce heat upon exposure to light, the figures will rise without being affected by heat from adjoining figures.

Still further, in this embodiment, although optically absorptive figures are formed by thermal transfer, the method for producing figures is not limited to thermal transfer so long as the figures are optically absorptive. It is also possible to draw figures by means of various methods; for example, electrophotography, a pen plotter, and hand writing using a pen.

The operation for setting an interval between image patterns of the tape printer 1 shown in FIG. 9 will now be explained with reference to FIGS. 12 and 13. The operation is executed with the apparatus illustrated in FIG. 11.

For example, four image patterns 26, 27, 28 and 29 shown in FIG. 13 are printed on a thermal expansile tape. In step S1, CPU 101 recognizes data stored in an input buffer (RAM 103) as image pattern data and separates individual image patterns. The CPU 101 selects two adjacent patterns in step S2 and determines the distance K between the two selected patterns (step S3). In step S4, the CPU 101 calculates the area of each of the two image patterns, and in step S5, the CPU 101 calculates the diameter R of a circle having the same area as the largest of the two patterns. The CPU 101 determines whether K>R * 0.3 (step S6), and if so, dot pattern data is developed for printing and is stored in the print buffer (RAM 103), and the CPU moves to step S10. In step S10, it is determined whether all image patterns are stored in the print buffer, and if so, the operation is ended. If the response in step S10 is "NO," the CPU 101 returns to step S2.

If the response in step S6 is "NO" the CPU 101 determines whether the distance K is alterable; that is, whether the space available on the printed tape is sufficient to increase the distance K (step S7). If the response in step S7 is "YES," the CPU 101 increases the distance K between the selected patterns so that K>R * 0.3 (step S9), and the CPU 101 moves to step S10. If the response in step S7 is "NO," the CPU 101 executes a known processing to reduce the area of at least one of the image patterns so that K>R * 0.3 (step S8), and the CPU 101 moves to step S10.

The operation is repeated until all image patterns are properly spaced from one another and all image pattern data is stored in the print buffer.

While this invention has been described in conjunction with specific embodiments thereof, it is evident that many alternatives, modifications and variations will be apparent to those skilled in the art. Accordingly, the preferred embodiments of the invention as set forth herein are intended to be illustrative, not limiting. Various changes may be made without departing from the spirit and scope of the invention as defined in the following claims.

What is claimed is:

1. A relief pattern producing method comprising the steps of:

forming a plurality of image patterns on a thermal expansile sheet having a thermal expansile layer laid on a base material layer, said thermal expansile layer including a foaming agent that is foamed upon heating;

exposing said thermal expansile sheet to light including infrared rays; and causing a part of said thermal expansile layer covered with said image patterns formed on said thermal expansile sheet to be heated and foamed, by virtue of said exposure, so that relief patterns corresponding to said image patterns are formed on said thermal expansile sheet, wherein said step of forming said plurality of image patterns on said thermal expansile sheet includes setting an interval between two arbitrary adjoining image patterns of more than two image patterns formed on said thermal expansile sheet to more than about 0.3 times as large as a diameter of a circle whose area is the same as an area of said image patterns.

2. The relief pattern producing method according to claim 1, wherein said step of forming said plurality of image patterns on said thermal expansile sheet includes the steps of:

calculating a diameter of a circle having the same area as said image patterns from an area of each of said image patterns; and arranging two arbitrary adjoining image patterns on the basis of a result of said calculation.

3. The relief pattern producing method according to claim 1, wherein said step of forming said plurality of image patterns on said thermal expansile sheet includes setting an interval between two arbitrary adjoining image patterns of more than two image patterns formed on said thermal expansile sheet to more than about 0.3 times as large as a diameter of a circle whose area is the same as an area of a larger one of said two image patterns.

4. The relief pattern producing method according to claim 1, wherein said step of forming said plurality of image patterns on said thermal expansile sheet includes setting an interval between two arbitrary adjoining image patterns of said plurality of image patterns formed on said thermal expansile sheet to more than about 0.5 times as large as a diameter of a circle whose area is the same as an area of a larger one of said two image patterns.

5. The relief pattern producing method according to claim 1, further comprising the step of blowing air toward a surface of said thermal expansile layer to prevent an increase in ambient temperature around said thermal expansile layer, whereby a difference in temperature is increased between areas that absorb light to bring about a temperature rise and areas that reflect light to prevent a temperature rise.

6. The relief pattern producing method according to claim 1, comprising forming said image patterns of a material that is highly optically absorptive.

7. The relief pattern producing method according to claim 1, comprising forming said image patterns by a thermal transfer recorder.

8. The relief pattern producing method according to claim 1, wherein said step of exposing said thermal expansile sheet to light including infrared rays includes exposing said thermal expansile sheet while either said thermal expansile sheet or a light source of said light is being moved.

9. The relief pattern producing method according to claim 1, wherein substances, which evolve nontoxic gas as a result of thermal decomposition, are appropriately used as said foaming agent, said substances being selected from the group consisting of bicarbonate peroxide, diazoaminobenzene, aluminum para-dicarboxylate, and azo compounds.

10. The relief pattern producing method according to claim 1, wherein said thermal expansile layer comprises a foaming agent dispersed in a thermoplastic resin.

11. The relief pattern producing method according to claim 1, wherein the foaming agent is a thermal expansile microcapsule having a diameter of 10–20 μm.

12. The relief pattern producing method according to claim 1, wherein said step of setting an interval between two arbitrary adjoining image patterns comprises:

calculating a distance between said two arbitrary adjoining image patterns;

calculating an area of each of said two arbitrary adjoining image patterns;

calculating a diameter of a circle having the same area as each of said two arbitrary adjoining image patterns; and determining whether said interval is more than about 0.3 times as large as the calculated diameter of the circle corresponding to a larger of said two arbitrary adjoining image patterns.

13. The relief pattern producing method according to claim 12, wherein if said interval is not more than about 0.3 times as large as the calculated diameter of the circle corresponding to a larger of said two arbitrary adjoining image patterns, said step of setting an interval between two arbitrary adjoining image patterns further comprises determining whether said interval can be increased, and (1) if said interval can be increased, increasing said interval so that said interval is more than about 0.3 times as large as the calculated diameter of the circle corresponding to a larger of said two arbitrary adjoining image patterns, and (2) if said interval cannot be increased, reducing the area of one of said two arbitrary adjoining image patterns so that said interval is more than about 0.3 times as large as the calculated diameter of the circle corresponding to a larger of said two arbitrary adjoining image patterns.

* * * * *